US008187029B2

(12) United States Patent
Yu et al.

(10) Patent No.: US 8,187,029 B2
(45) Date of Patent: May 29, 2012

(54) ELECTRICAL CONNECTOR WITH STACKED SPACERS

(75) Inventors: Chun-Ming Yu, Kunshan (CN); Jia-Yong He, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/090,282

(22) Filed: Apr. 20, 2011

(65) Prior Publication Data

US 2011/0294352 A1 Dec. 1, 2011

(51) Int. Cl.
*H01R 13/66* (2006.01)

(52) U.S. Cl. ..... 439/541.5

(58) Field of Classification Search ..... 439/541.5, 439/79, 540.1, 607.23, 607.24, 607.32, 607.34, 439/607.1–607.12, 607.07, 676
See application file for complete search history.

(56) References Cited

U.S. PATENT DOCUMENTS 6,095,826 A * 8/2000 Potters ..... 439/79
6,099,351 A * 8/2000 Wu ..... 439/607.43
6,155,872 A * 12/2000 Wu ..... 439/541.5
6,234,834 B1 * 5/2001 Tsai et al. ..... 439/541.5
6,238,241 B1 * 5/2001 Zhu et al. ..... 439/541.5
6,386,918 B1 * 5/2002 Zheng et al. ..... 439/607.45
6,547,590 B2 * 4/2003 Zhu et al. ..... 439/540.1
6,814,612 B1 * 11/2004 Hu et al. ..... 439/541.5
7,103,753 B2 * 9/2006 Crane, Jr. ..... 712/33
7,179,095 B1 * 2/2007 Peng et al. ..... 439/74
7,364,463 B1 * 4/2008 Ju ..... 439/607.55
7,473,136 B2 * 1/2009 Hu et al. ..... 439/607.01
7,517,253 B1 * 4/2009 Chiang ..... 439/660
7,534,143 B1 * 5/2009 Tsao et al. ..... 439/607.41
7,578,696 B2 * 8/2009 Yuan ..... 439/485
7,588,458 B2 * 9/2009 He et al. ..... 439/541.5
7,621,780 B2 * 11/2009 Magnusson ..... 439/607.23
7,651,371 B2 1/2010 Yi et al.
7,758,380 B2 * 7/2010 Wang et al. ..... 439/607.23
2009/0305555 A1 * 12/2009 Wang et al. ..... 439/541.5
2010/0173529 A1 7/2010 He et al.

* cited by examiner

*Primary Examiner* — Tulsidas C Patel
*Assistant Examiner* — Harshad Patel
(74) *Attorney, Agent, or Firm* — Wei Te Chung; Andrew C. Cheng; Ming Chieh Chang

(57) ABSTRACT

An electrical connector includes a housing with a number of passageways, a plurality of contacts retained in the passageways, and a spacer assembly assembled to a rear side of the housing. The contacts are arranged in plural rows along an insertion direction of a mating plug. Each contact has a connecting portion extending along an up to down direction. The spacer assembly has at least two spacers stacked with each other along the up to down direction to jointly receive and position the connecting portions.

20 Claims, 8 Drawing Sheets

ELECTRICAL CONNECTOR WITH STACKED SPACERS

BACKGROUND OF THE INVENTION

1. Field of the Invention

The present invention relates to an electrical connector, and more particularly to an electrical connector with a pair of stacked spacers for positioning contacts thereof.

2. Description of Related Art

A stacked electrical connector, mounted on a PCB for electrically connecting with a number of plugs, is typically described in U.S. Pat. No. 6,155,872, which was issued on Dec. 5, 2000. The stacked electrical connector includes an insulative housing, a number of contacts retained on the housing, and a spacer retained on the housing to position the contacts.

The housing defines three insert openings for receiving the plugs. The insert openings are arranged along an up to down direction for decreasing the occupied area of the PCB. The contacts include a number of first contacts arranged in an upper insert opening of said three insert openings, a number of second contacts arranged in a middle insert opening, and a number of third contacts arranged in a lower insert opening. Each contact has a securing portion horizontally secured in the housing, a contact portion extending into the insert opening from a front end of the securing portion, a connecting portion downwardly bending from a rear end of the securing portion, and a tail portion further downwardly extending from a lower end of the connecting portion. The spacer defines a number of through holes to receive and position the connecting portions for preventing adjacent contacts from contacting with each other. The mold for forming the spacer has a plurality of slim core pins to form the through holes.

As described above, the electrical connector is formed with tree insert openings along the up to down direction for connecting with three plugs, then the connecting portions of the first contacts should be designed with a long length for making the tail portions extend beyond a lower side of the housing to connect with the PCB. At this time, the spacer should be designed with an enough height to receive the connecting portions and prevent the connecting portions of the first contacts from inclining to contact with other connecting portions, and the through holes would have a long length at the same time. Therefore, the slim core pins on the mold for forming the through holes would be too longer and are easily destroyed.

Hence, an improved electrical connector is desired to overcome the above problems.

BRIEF SUMMARY OF THE INVENTION

According to the present invention, an electrical connector, comprises: an insulative housing, a plurality of contacts retained on the housing, and a spacer assembly assembled to the housing to position the contacts. Each contact has a retaining portion retained in the housing, a contact portion extending from one end of the retaining portion for connecting with a corresponding plug, a connecting portion extending from another end of the retaining portion along an up to down direction, and a tail portion extending out of the housing from the connecting portion. The spacer assembly has a first spacer and a second spacer stacked with each other along the up to down direction. The first spacer defines a plurality of first through holes to position an upper side of the connecting portions, and the second spacer defines a plurality of second through holes which are aligned with the first through holes along the up to down direction to position a lower side of the connecting portions.

According to another aspect of the present invention, an electrical connector, comprises: a housing defining a plurality of passageways, a plurality of contacts retained in the housing, and a spacer assembly assembled to a rear side of the housing. The contacts are arranged in plural rows along an insertion direction of a mating plug. Each contact has a connecting portion extending along an up to down direction. The spacer assembly has at least two spacers stacked with each other along the up to down direction to jointly receive and position the connecting portions.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
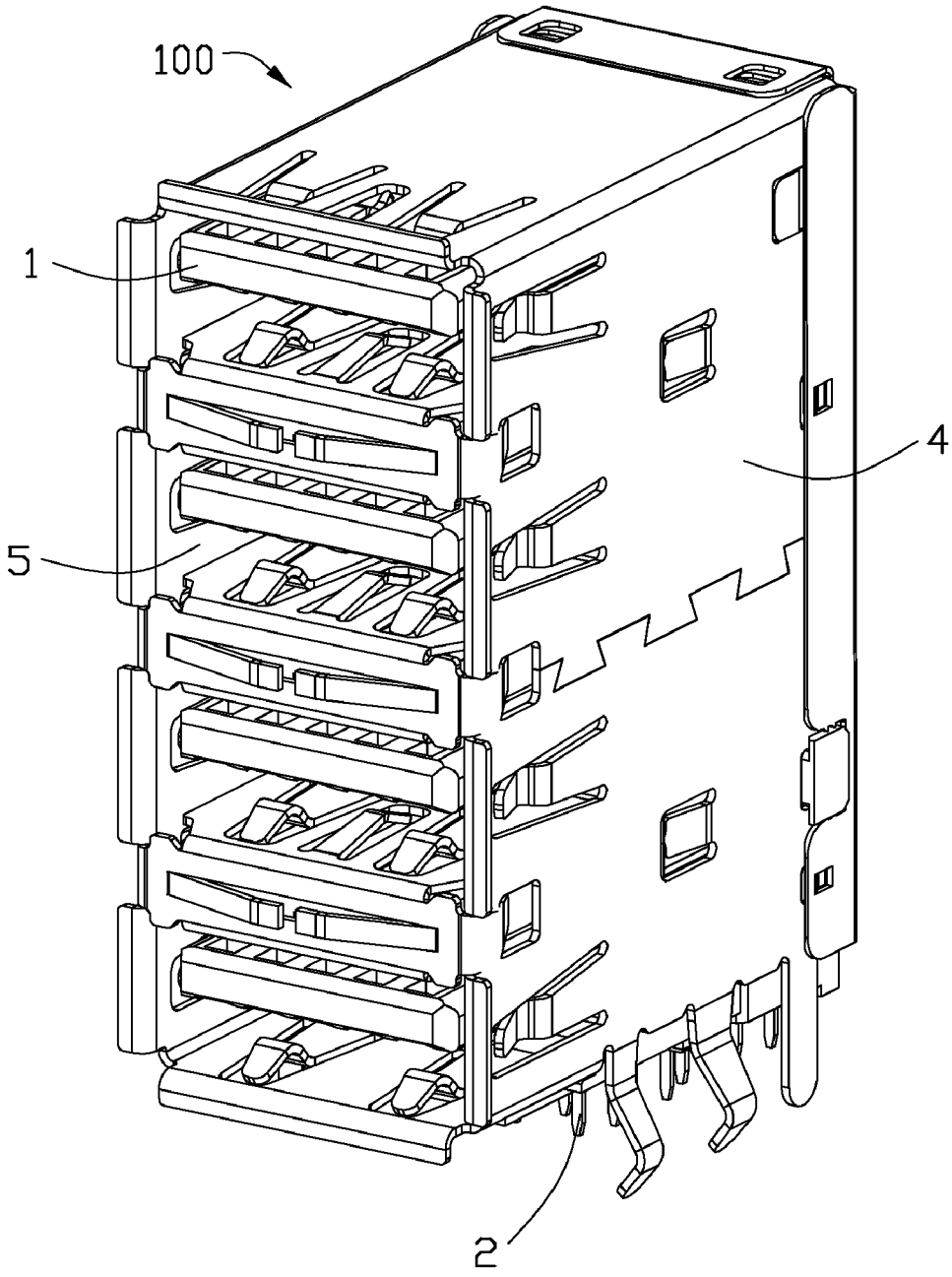
FIG. 1 is a perspective view of an electrical connector according to the present invention.
Figure 2:
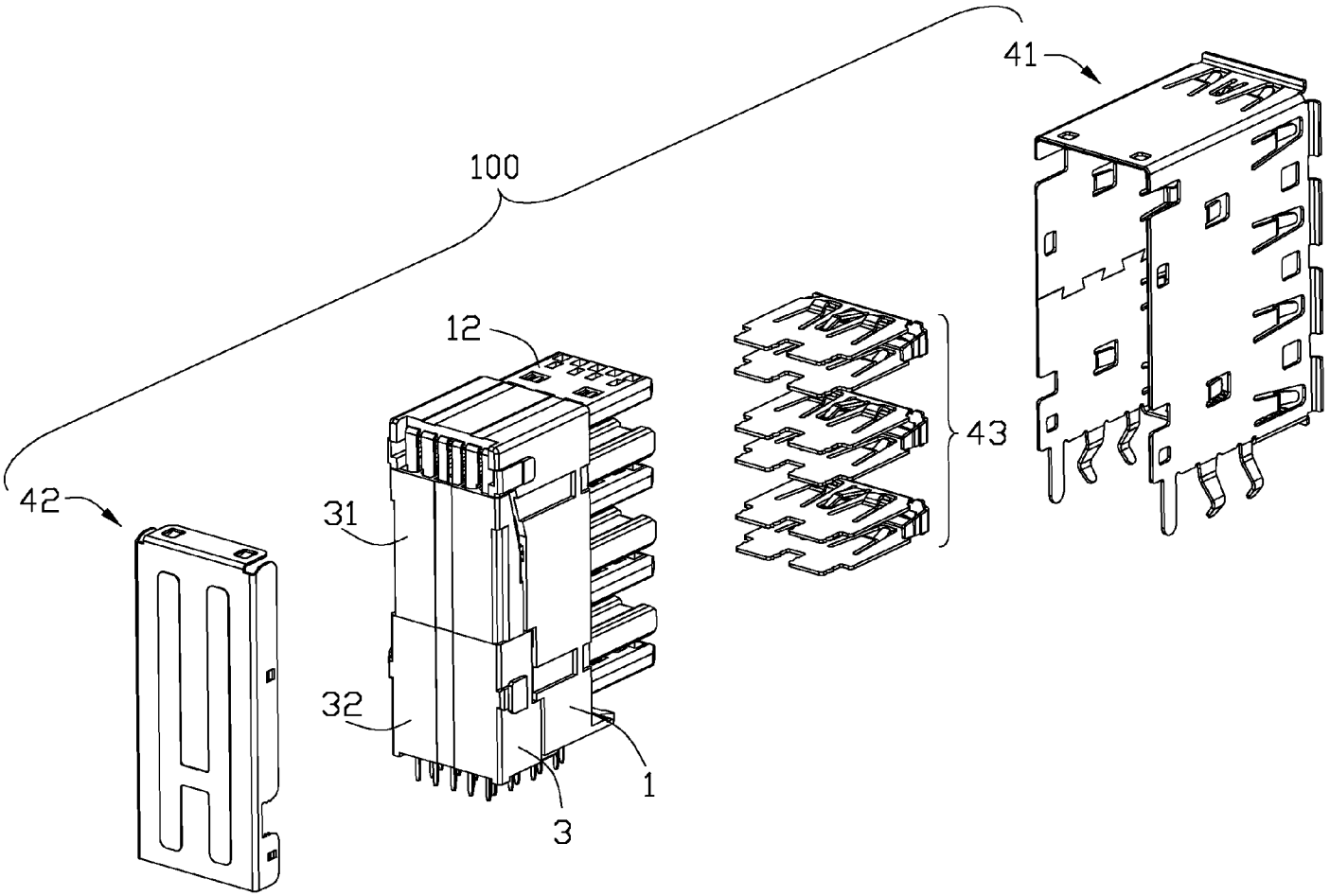
FIG. 2 is a partly exploded view of the electrical connector shown in FIG. 1.
Figure 3:
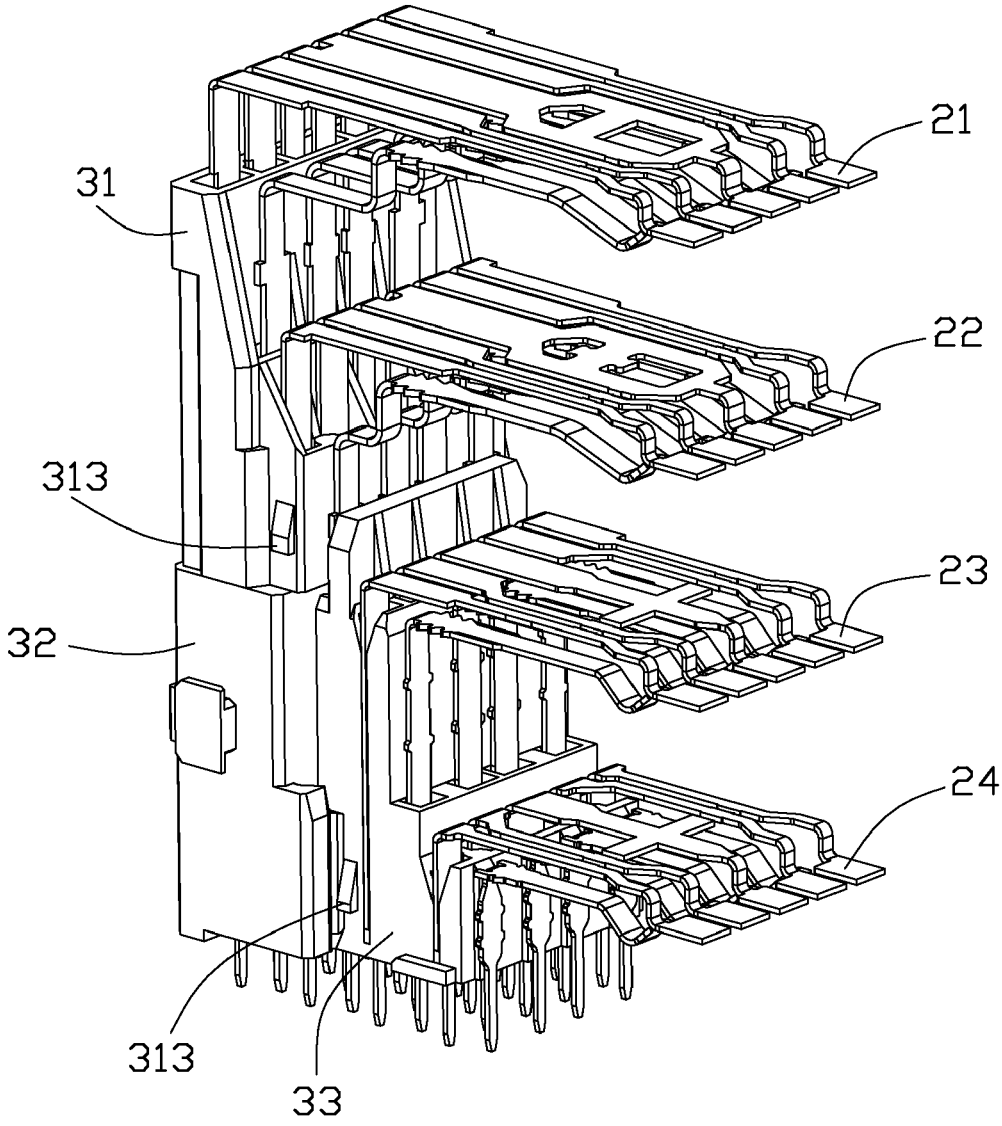
FIG. 3 is a perspective view of a plurality of spacers and contacts of the electrical connector shown in FIG. 1.
Figure 4:
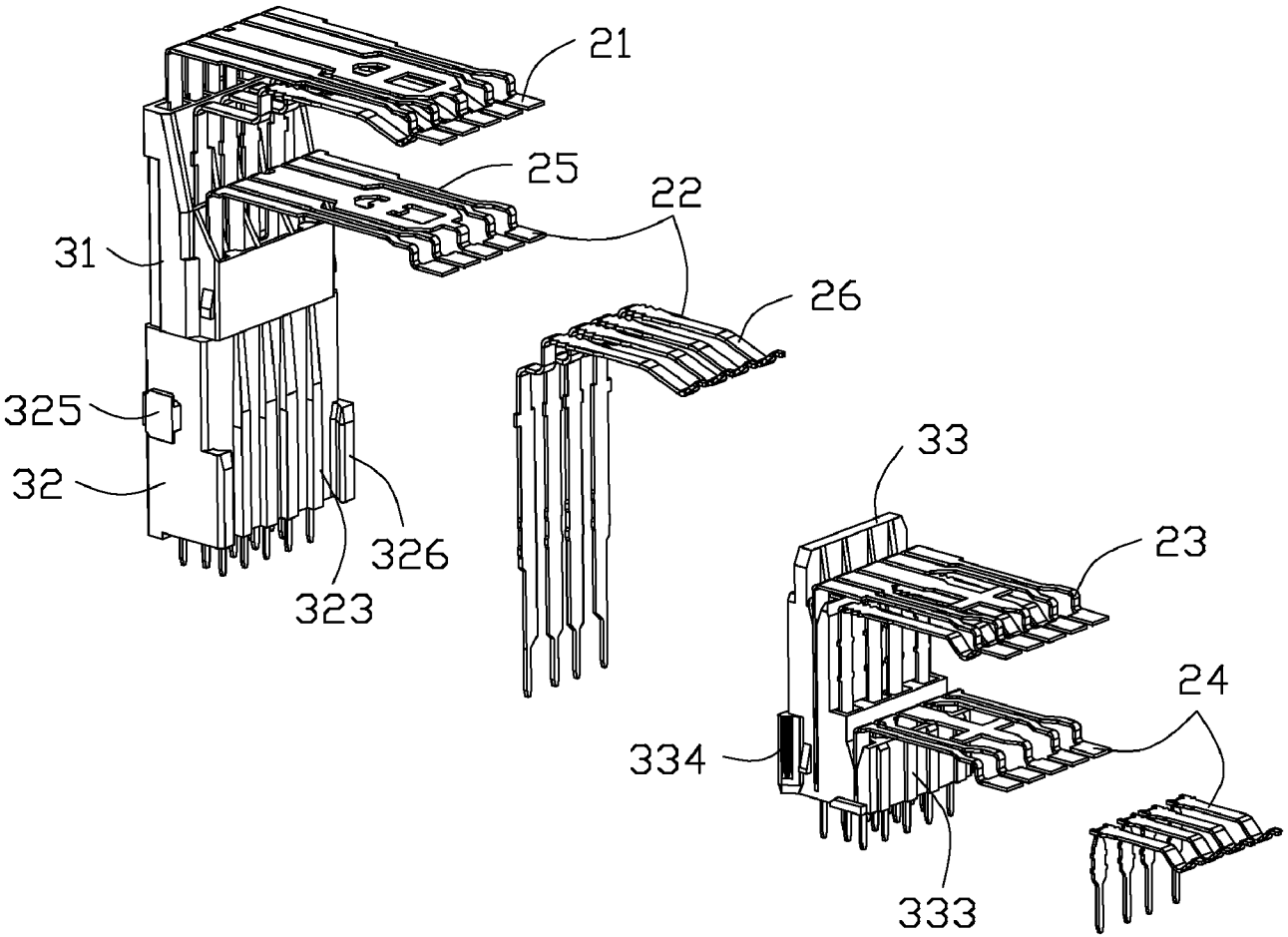
FIG. 4 is a partly exploded view of the spacers and contacts shown in FIG. 3.
Figure 5:
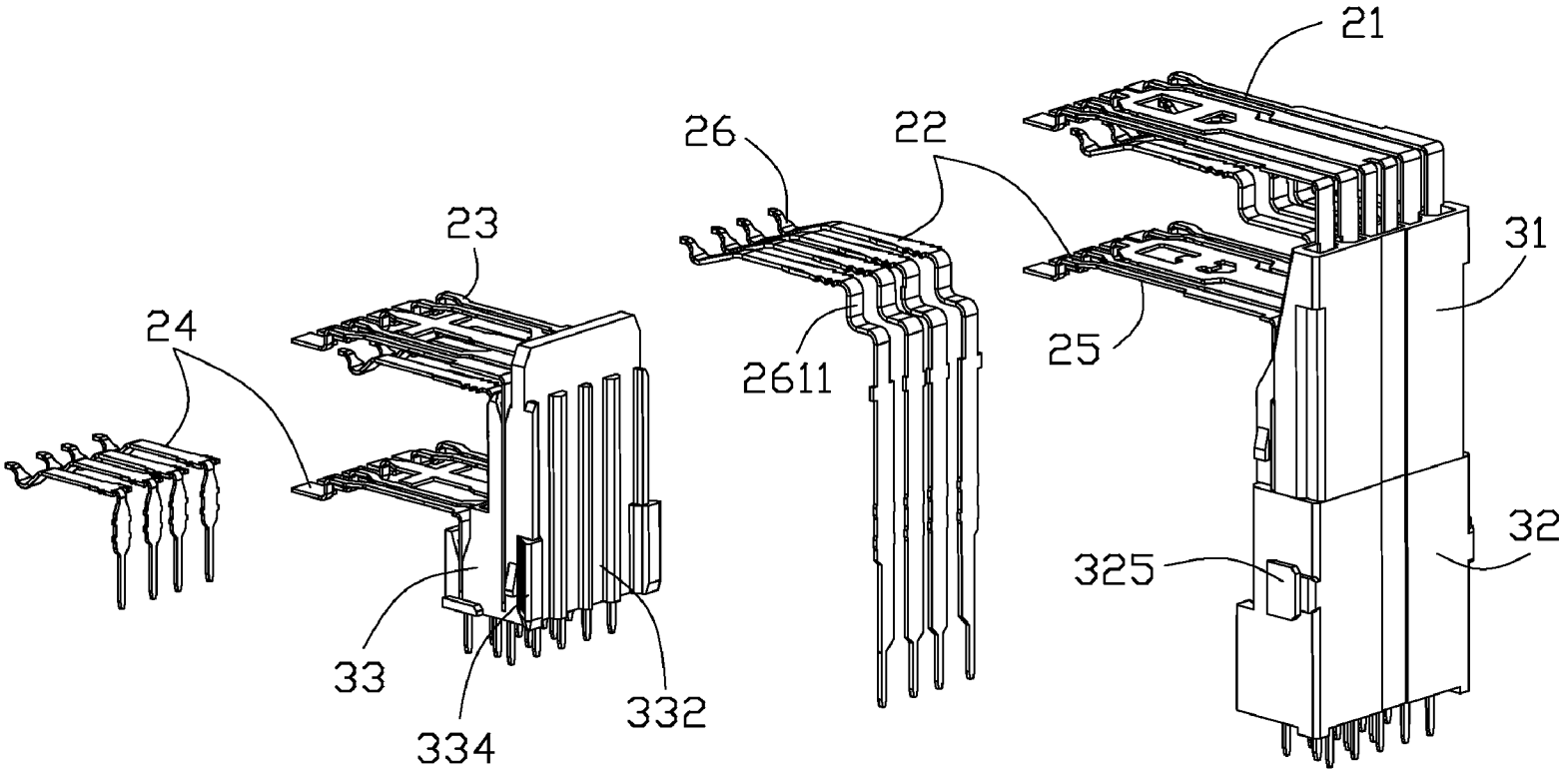
FIG. 5 is a view similar to FIG. 4, while taken from a different aspect.
Figure 6:
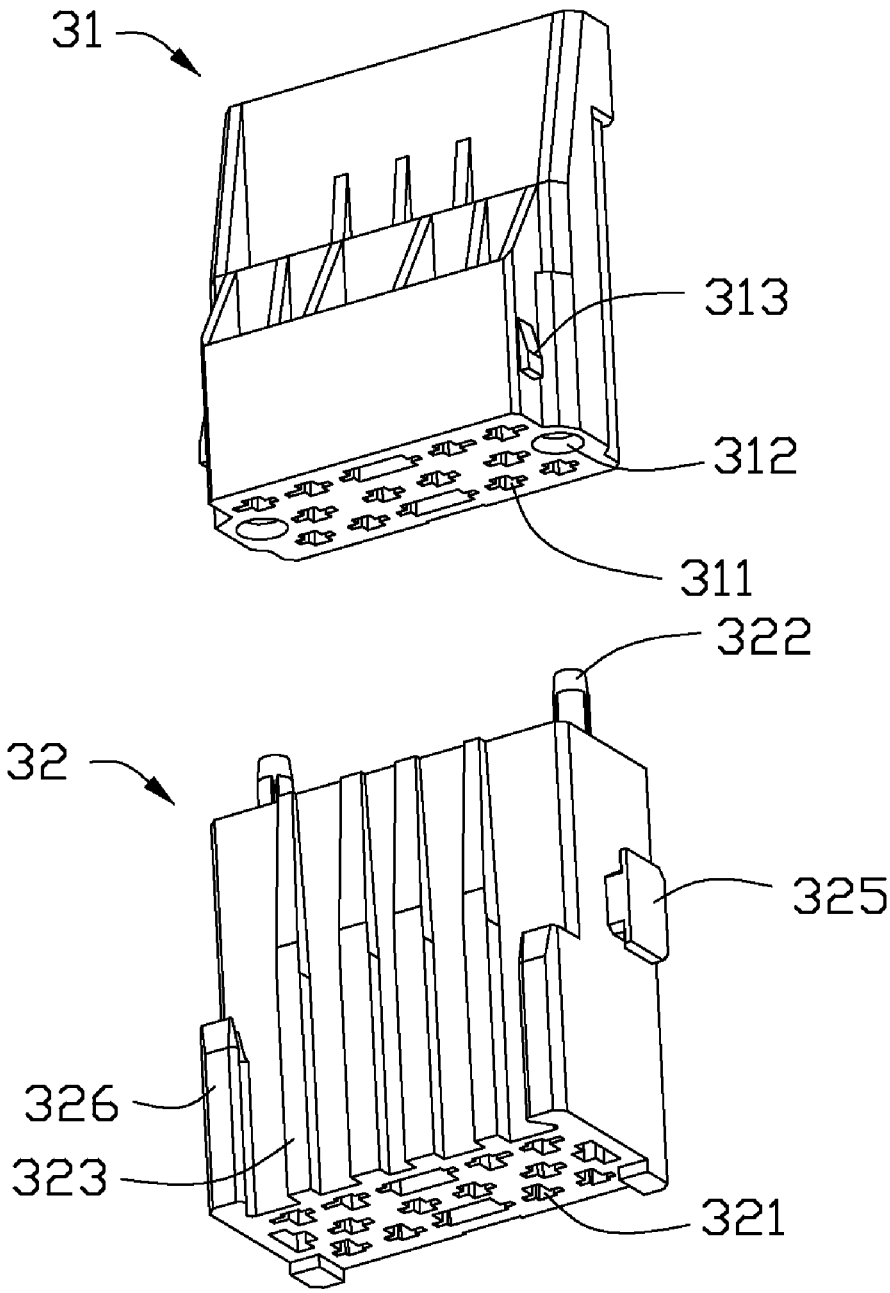
FIG. 6 is a perspective view of a first spacer and a second spacer of the electrical connector shown in FIG. 1.

In the following description, numerous specific details are set forth to provide a thorough understanding of the present invention. However, it will be obvious to those skilled in the art that the present invention may be practiced without such specific details.

Referring to FIGS. 1-8, an electrical connector 100 according to the present invention is disclosed. The connector 100 is a stacked USB 3.0 receptacle connector and defines four insert openings 5 for mating with four USB 3.0 plugs (not shown). The electrical connector 100 comprises an insulative housing 1, a plurality of contacts 2 retained on the housing 1, a spacer assembly 3 attached to a rear side of the housing 1 to position the contacts 2, and a metal shell 4 covering the housing 1.

Figure 7:
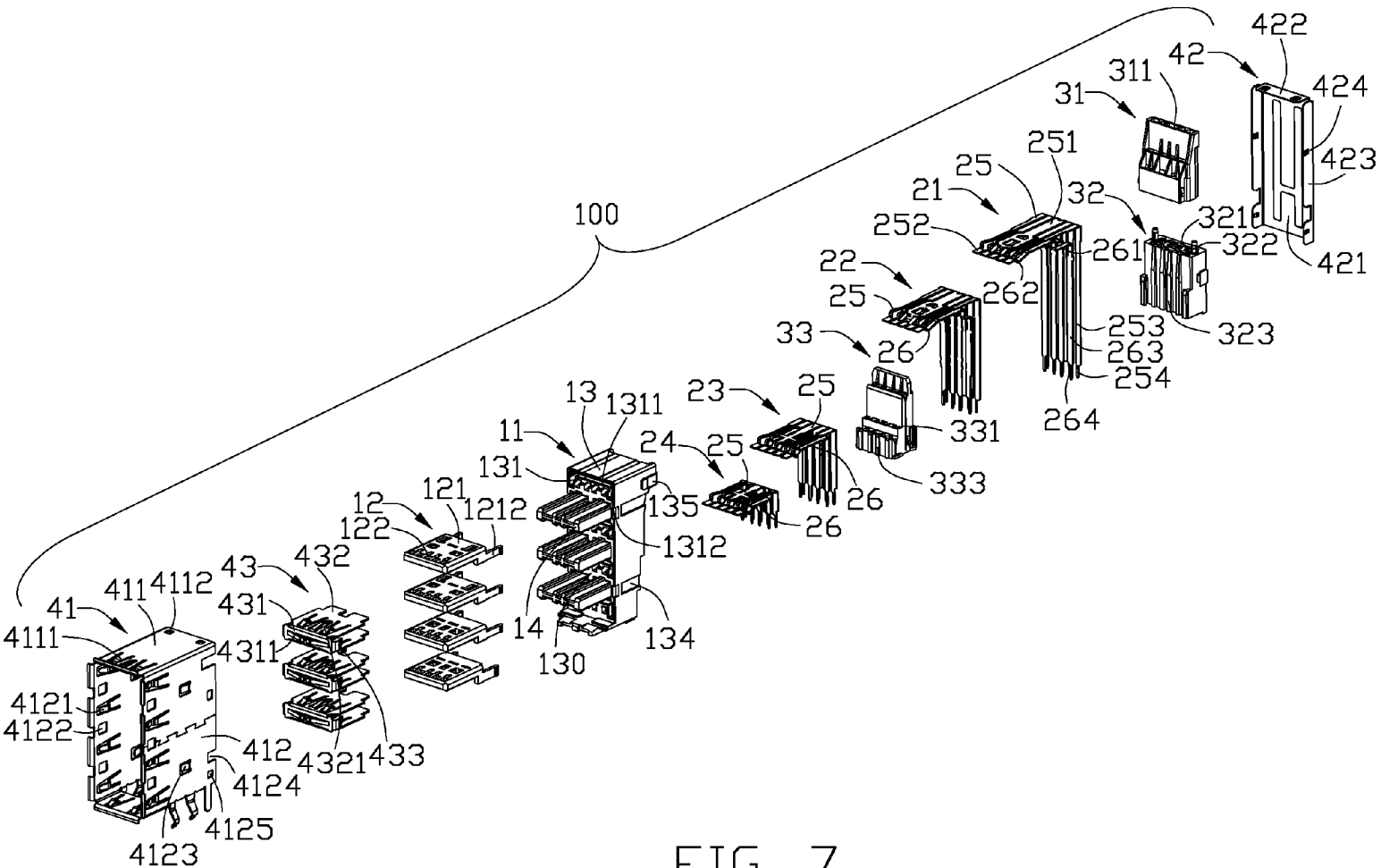
FIG. 7 is an exploded view of the electrical connector shown in FIG. 1.
Figure 8:
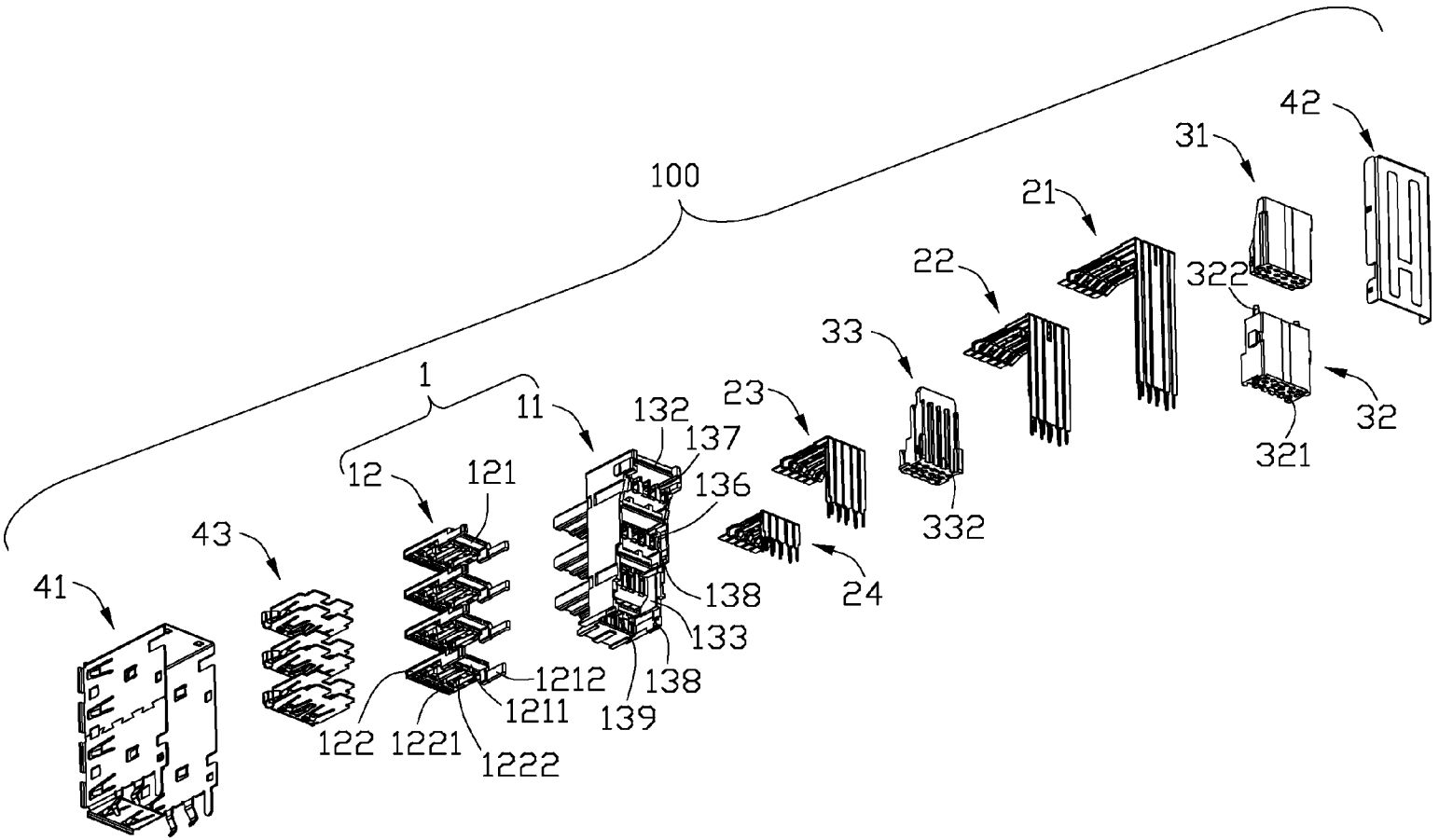
FIG. 8 is a view similar to FIG. 7, while taken from a different aspect.

Referring to FIGS. 7-8, the housing 1 comprises a base 11 and four tongues 12 attached to the base 11. The base 11 has a body portion 13 and three plates 14 forwardly extending from a front surface 130 of the body portion 13. The plates 14 are parallel to each other and spaced apart from each other along an up to down direction. The body portion 13 defines a plurality of cavities 131 backwardly recessed from the front surface 130 thereof to position the tongues 12, a plurality of first passageways 132 located behind and communicating with the cavities 131, and a plurality of second passageways 137 located below the cavities 131 and extending therethrough along a front to back direction. The front to back direction is also the insertion direction of the plug. Each cavity 131 has a transverse first cavity 1311 and a pair of second cavities 1312 downwardly extending from two sides of the first cavity 1311. The second cavities 1312 are located at two sides of the second passageways 137 along a transverse direction perpendicular to the up to down direction and the front to back direction. The body portion 13 defines a receiving space 133 at a rear side thereof to receive and retain the spacer assembly 3, and two pairs of lockers 138 protruding into the receiving space 133 from two sides thereof. The body portion 13 defines a plurality of recesses 134 and a plurality of protrusions 135 at two sides thereof to engage with the metal shell 4, a plurality of first grooves 136 and a plurality of second grooves 139 extending along the up to down direction at a rear side thereof. The first and second grooves 136, 139 align to the second passageways 137 along the up to down direction. The second grooves 139 are located below the first grooves 136 and downwardly extend through the body portion 13.

Each tongue 12 has a fixing section 121 fixed in the cavity 131 and a mating section 122 forwardly extending into the insert opening 5. The fixing section 121 has a level portion 1211 retained in the first cavity 1311 to prevent the tongue 12 from moving along the up to down direction, and a pair of arms 1212 backwardly extending from a lower side of the level portion 1211. The arms 1212 are received in the second cavities 1312 and catch a rear side of the body portion 13, and the level portion 1211 backwardly resists a rear inner wall of the first cavity 1311, thereby the tongue 12 can not move along a front to back direction. The mating section 122 is formed with a plurality of first depressions 1221 depressed from a front side of a bottom surface thereof, a plurality of ribs between adjacent first depressions 1221, and a plurality of second depressions 1222 behind the first depressions 1221 along the front to back direction. The first depressions 1221 extend through a front end of the mating section 122. The second depressions 1222 space apart from the first depressions 1221 along the front to back direction.

The contacts 2 are arranged in four groups along the up to down direction, which comprise a first contact group 21, a second contact group 22, a third contact group 23 and a fourth contact group 24. Each contact group 21, 22, 23, 24 has five first contacts 25 and four second contacts 26 below the first contacts 25 along the up to down direction. The five first contacts 25 in each contact group 21, 22, 23, 24 comprise two pairs of differential signal contacts and a grounding contact between said two pairs of differential signal contacts.

The first contacts 25 are insert molded in the tongues 12. Each first contact 25 has a first retaining portion 251 insert molded in the tongue 12, a first contact portion 252 forwardly extending into the first depression 1221 from a front end of the first retaining portion 251, a first connecting portion 253 downwardly extending from a rear end of the first retaining portion 251, and a first tail portion 254 downwardly extending from a lower end of the first connecting portion 253. The tongue 12 and the first contacts 25 are backwardly assembled to the base 11 before the first connecting portions 253 are bended downwardly. Each second contact 26 has a second retaining portion 261 retained in the second passageways 137, a second contact portion 262 forwardly extending to the second depressions 1222 from a front end of the second retaining portion 261, a second connecting portion 263 downwardly extending from a rear end of the second retaining portion 261, and a second tail portion 264 downwardly extending from a lower end of the second connecting portion 263. The second retaining portion 261 has a bending portion 2611 downwardly and backwardly extending at a rear side thereof to engage with the first grooves 136 of the body portion 13.

The first contact portions 252 are flatly affixed to a bottom inner surface of the first depressions 1221, and downwardly exposed to the insert opening 5. The second contact portions 262 are cantileveredly received in the second depressions 1222 and downwardly protrude into the insert opening 5. The first retaining portion 251 and first connecting portion 253 of the grounding contact in the first contacts 25 are wider than that of the differential signal contacts along the transverse direction. The first retaining portion 251 has a rear end portion which backwardly penetrate through and is retained in the first passageways 132. The first connecting portions 253 and the second connecting portions 263 in each contact group 21, 22, 23, 24 are arranged in two rows along the front to back direction, and the first connecting portions 253 in each contact group 21, 22, 23, 24 are arranged in a row behind the second connecting portions 263. Therefore, the connecting portions 253, 263 of all contacts 2 are arranged in eight rows from the fourth contact group 24 to the first contact group 21 along the front to back direction.

Referring to FIGS. 3-8, the spacer assembly 3 comprises a first spacer 31, a second spacer 32 stacked with the first spacer 31 along the up to down direction, and a third spacer 33 sandwiched between the body portion 13 and the second spacer 32. The first spacer 31 defines a plurality of first through holes 311 to receive the upper sides of the connecting portions 253, 263 in the first contact group 21 and the first connecting portions 253 in the second contact group 22. The second spacer 32 defines a plurality of second through holes 321 aligned with the first through holes 311 along the up to down direction. The lower sides of the connecting portions 253, 263 in the first contact group 21 and the first connecting portions 253 in the second contact group 22 are positioned in the second through holes 321. The first and second through holes 311, 321 are cross-shaped.

The second connecting portions 263 are formed with a plurality of barbs at two sides thereof to engage with the through holes 311, 321. The first spacer 31 defines a pair of position holes 312 recessed from a bottom surface thereof. The position holes 312 are located at two sides of all first through holes 311 along the transverse direction. The second spacer 32 is formed with a pair of posts 322 upwardly extending from a top surface thereof to engage with the position holes 312 of the first spacer 31. The posts 322 are located at two sides of all second through holes 321 along the transverse direction. Therefore, the first spacer 31 and the second spacer 32 are stacked and combined with each other along the up to down direction to jointly position the connecting portions 253, 263 in the first contact group 21 and the first connecting portions 253 in the second contact group 22, which can decrease the length of the through holes 311, 321 on the first and second spacers 31, 32. Then the core pins (not shown) for forming the through holes 311, 321 would be short enough and not be easily destroyed. Besides, the combined first and second spacers 31, 32 can be designed with an enough height to receive the connecting portions 253, 263, which can improve a high frequency performance of the differential signal contacts in the first contacts 25. The second spacer 32 has a pair of protrusions 325 at two sides thereof to lock with the metal shell 4, and a pair of hooks 326 forwardly extending from two sides thereof.

The third spacer 33 defines a plurality of third through holes 331 and a plurality of slots 332 recessed from a rear side thereof. The connecting portions 253, 263 in the third contact group 23 and the first connecting portions 253 in the fourth contact group 24 are received and positioned in the third through holes 331. The second connecting portions 263 in the second contact group 22 are forwardly received in the slots 332. The second spacer 32 is formed with a plurality of first blocks 323 at a front side thereof. The first blocks 323 extend along the up to down direction and are forwardly received in the slots 332 to resist a rear side of the second connecting portions 263 in the second contact group 22. The second connecting portions 263 in the fourth contact group 24 are received in the second grooves 139 of the housing 1. The third spacer 33 is formed with a plurality of second blocks 333 at a front side thereof. The second blocks 333 extend along the up to down direction and are forwardly received in the second grooves 139 to resist a rear side of the second connecting portions 263.

The third spacer 33 has a pair of projections 334 at two sides thereof. The hooks 326 on the second spacer 32 lock with the projections 334 to fastening the second and third spacers 32, 33 together. The first and third spacer 31, 33 are formed with a plurality of raised portions 313 outwardly extending from two sides thereof to lock with the lockers 138 of the housing 1.

As fully described above, the connecting portions 253, 263 in the first contact group 21 and the first connecting portions 253 in the second contact group 22 constitute rear connecting portions positioned in the first and second spacers 31, 32. The upper sides of the rear connecting portions are positioned in the first through holes 311 of the first spacer 31, and the lower sides of the rear connecting portions are positioned in the second through holes 321 of the second spacer 32. The second connecting portions 263 in the second contact group 22 constitute middle connecting portions. The middle connecting portions are located at front of the rear connecting portions and sandwiched between the second spacer 32 and the third spacer 33. The middle connecting portions upwardly extend beyond the second spacer 32 and lower than the combined first and second spacers 31, 32. The third spacer 33 has a height between that of the second spacer 32 and the combined first and second spacers 31, 32 to prevent the middle connecting portions from inclining forwardly. The connecting portions 253, 263 in the third contact group 23 and the first connecting portions 253 in the fourth contact group 24 constitute front connecting portions which are located at front of the middle portions. The front connecting portions are received in the third through holes 331 of the third spacer 33. The second connecting portions 263 in the fourth contact group 24 are sandwiched between the third spacer 33 and the housing 1.

The metal shell 4 comprises a first shell 41, a second shell 42 engaging with the first shell 41 along the front to back direction, and a plurality of inner shells 43 shielding the plates 14. The first shell 41 has a top wall 411 covering a top side of the housing 1, and a pair of side walls 412 downwardly extending from two sides of the top wall 411 to cover two sides of the housing 1. The top wall 411 is formed with a pair of first spring arms 4111 forwardly and downwardly extending into the insert openings 5, and a pair of hollows 4112 at a rear side thereof. Each side wall 412 is formed with a plurality of second spring arms 4121 forwardly and sidewardly extending into the insert openings 5 respectively, and a plurality of openings 4122 between adjacent two second spring arms 4121. Each side wall 412 further has a pair of resisting tangs 4123 forwardly extending to resist a front inner wall of the recesses 134, and a pair of cutouts 4124 to engage with protrusions 135, 325 on the housing 1 and the second spacer 32. Each side wall 412 has a pair of lock holes 4125 below the cutouts 4124 to engage with the second shell 42.

The second shell 42 has a rear cover 421 covering a rear side of the housing 1 and the spacer assembly 3, a top edge 422 forwardly extending front a top end of the rear cover 421, and a pair of side edges 423 forwardly extending from two sides of the rear cover 421. The top edge 422 and side edges 423 define a plurality of locking tangs 424 to lock with the hollows 4112 and the lock holes 4125.

Each inner shell 43 has a front cover 431 covering a front side of the plate 14, a pair of extension portion 432 backwardly and respectively extending from upper and lower sides of the front cover 431, and a pair of locking latches 433 backwardly extending from left and right sides of the front cover 431. The front cover 431 has a pair of grounding tabs 4311 forwardly extending to engage with a shell of computer (not shown) for grounding. Each extension portion 432 has a pair of third spring arms 4321 forwardly and upwardly or downwardly extending into the insert openings 5 to lock with the corresponding plug. The locking latches 433 lock with the openings 4122 of the first shell 41.

The spacer assembly 3 in the present invention comprises three spacers 31, 32, 33 to position the contacts 2. However, the spacer assembly 3 can also alternatively consist of the first and second spacers 31, 32, then the second spacer 32 would be designed with a plurality of second through hole 321 which is more than the first through holes 311 in the first spacer 31, and the connecting portions 253, 263 in the first, second and third contact groups 21, 22, 23 and the first connecting portions 253 in the fourth contact group 24 constitute rear connecting portions which are positioned in the second through holes 321, and the second connecting portions 263 in the fourth contact group 24 constitute middle connecting portion which are received in the second grooves 139 of the housing 1.

As fully described above, the electrical connector 100 in the present invention comprises at least two spacers 31, 32 combined with each other along the up to down direction to position the contacts 2, which can decrease a height of each spacer 31, 32, then the core pins for forming the through holes 311, 321 will has a short length and are not easily destroyed. Besides, the separated first and second spacers 31, 32 can be designed with enough height to improve high frequency performance of the differential signal contacts.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed. For example, in the embodiment of the application, the tongue is rearwardly inserted into the corresponding cavity. Alternately, it is also available to rearrange the housing and the tongue for allowing the tongue to be forwardly assembled into the cavity of the housing.

What is claimed is:

1. An electrical connector, comprising:

an insulative housing;

a plurality of contacts retained on the housing, each contact having a retaining portion retained in the housing, a contact portion extending from one end of the retaining portion for connecting with a corresponding plug, a connecting portion extending from another end of the retaining portion along an up to down direction, and a tail portion extending out of the housing from the connecting portion; and a spacer assembly assembled to the housing to position the contacts;

wherein the spacer assembly has a first spacer and a second spacer stacked with each other along the up to down direction, the first spacer defines a plurality of first through holes to position an upper side of the connecting portions, and the second spacer defines a plurality of second through holes which are aligned with the first through holes along the up to down direction to position a lower side of the connecting portions;

wherein the connecting portions are arranged in plural rows along a front to back direction, and the second spacer is formed with a plurality of first blocks at a front side thereof to resist one row of the connecting portions.

2. The electrical connector according to claim 1, wherein the first spacer defines at least one position hole upwardly recessed from a bottom surface thereof, and the second spacer is formed with at least one post upwardly extending from a top surface thereof to engage with the position hole.

3. The electrical connector according to claim 2, wherein the position hole is located outside of the first through holes along a transverse direction of the housing, and the post is located outside of the second through holes along the transverse direction.

4. The electrical connector according to claim 1, wherein the connecting portions comprise a plurality of rear connecting portions positioned in the first and second spacers, a plurality of middle connecting portions arranged at front of the rear connecting portions along the front to back direction, and the first blocks resist the middle connecting portions.

5. The electrical connector according to claim 1, wherein the housing defines a plurality of slots at a rear side thereof and extending along the up to down direction to receive the middle connecting portions, and the first blocks are forwardly received into the slots to make the middle connecting portions be sandwiched between the first blocks and the housing.

6. The electrical connector according to claim 1, wherein the spacer assembly further comprises a third spacer at front of the second spacer, and the connecting portions comprise a plurality of front connecting portions at front of the middle connecting portions, and the third spacer defines a plurality of third through holes to position the front connecting portions and a plurality of grooves at a rear side thereof to receive the middle connecting portions, and the first blocks forwardly received into the grooves to resist a rear side of the middle connecting portions.

7. The electrical connector according to claim 6, wherein the third spacer is formed with a pair of projections at two sides thereof, and the second spacer has a pair of hooks forwardly extending from two sides thereof to lock with the projections of the third spacer.

8. The electrical connector according to claim 6, wherein the middle connecting portions upwardly extend beyond the second spacer and lower than the combined first and second spacers, the third spacer has a height between that of the second spacer and the combined first and second spacers to prevent the middle connecting portions from inclining forwardly.

9. The electrical connector according to claim 1, wherein the housing has a receiving space at a rear side thereof and a pair of lockers extending into the receiving space from two sides thereof, the spacer assembly is received in the receiving space and formed with a plurality of raised portion outwardly protruding to lock with the lockers.

10. The electrical connector according to claim 1, wherein the electrical connector is a stacked USB 3.0 connector, the housing has a base and a plurality of tongues attached to the base, and the contacts are arranged in plural groups, and each group has a plurality of first contacts insert molded in the tongue and a plurality of second contacts attached to the base and extending to the tongue.

11. An electrical connector, comprising:

a housing defining a plurality of passageways;

a plurality of contacts retained in the housing, the contacts having connection portions extending in a vertical direction while being arranged in plural rows along a transverse direction perpendicular to said vertical direction; and a spacer assembly assembled to a rear side of the housing and having front and rear spacers being discrete while intimately stacked with each other along a front-to-back direction perpendicular to both said transverse direction and said vertical direction to jointly receive and position the connecting portions; wherein not only each of said front spacer and said rear spacer defines through holes in the vertical direction to receive and position the corresponding connecting portions but also an interface between the front spacer and the rear spacer defines slots in the vertical direction to receive and position the corresponding connecting portions.

12. The electrical connector according to claim 11, wherein the housing and the front spacer and the rear spacer are configured to allow both said front spacer and said rear spacer to be upwardly assembled to the housing in the vertical direction.

13. The electrical connector according to claim 12, wherein the rear spacer includes upper and lower parts discrete from while stacked with each other in the vertical direction, and having the corresponding through holes aligned with each other in the vertical direction, and the upper part defines stepped structure on an upper end thereof while the lower part defines a planar structure on an upper end thereof.

14. An electrical connector comprising:

an insulative housing defining a main body with at least a receiving cavity;

a metallic shell enclosing the housing except a mating port defined in front of the housing;

at least one mating tongue including a fixing section received in the receiving cavity, and a mating section extending forwardly from the fixing section with a mating face thereon under condition that a plurality of depressions are defined in the mating section;

a plurality of non-deflectable contacts embedded in the mating tongue with flat contacting sections exposed upon the mating face in front of the depressions and with tail sections extending vertically outside of the mating tongue in a perpendicular relation with the mating section;

a plurality of deflectable contacts assembled into the body with resilient contacting sections received in the corresponding depressions except mating apexes of the contacting sections, respectively, and with tail sections extending vertically outside of the mating tongue in the perpendicular relation with the mating section;

the mating tongue and the body being configured to allow the fixing section of the mating tongue to be snugly assembled to the body; and at least one spacer assembled around a rear side of the housing and defining a plurality of through holes to receive the tail sections of both said non-deflectable contacts and deflectable contacts therein; wherein a middle one of the non-deflection contacts defines a first width larger than a second width of all remainders of said non-deflection contacts.

15. The electrical connector assembly as claimed in claim 14, further including at least one additional mating tongue and at least one additional spacer.

16. The electrical connector assembly as claimed in claim 15, wherein said spacer and said additional spacer are vertical stacked with each other.

17. The electrical connector assembly as claimed in claim 15, wherein said spacer and said additional spacer are side by side assembled with each other.

18. The electrical connector as claimed in claim 14, wherein said spacer is assembled to the shell.

19. The electrical connector as claimed in claim 14, further including two mating tongues assembled to the housing parallel to said mating tongue, and two spacers both assembled with said spacer in a vertical stacked manner and a side-by-side manner, respectively.

20. The electrical connector according to claim 13, wherein the upper part and the lower part of the rear spacer includes means for engagement with each other in the vertical direction, and at least one of the upper part and the rear part has means for securing to the housing.

* * * * *